US009623429B1

(12) United States Patent
Anderton et al.

(10) Patent No.: US 9,623,429 B1
(45) Date of Patent: Apr. 18, 2017

(54) SPRAY PATTERN ADJUSTMENT SYSTEM FOR A SPRAY HEAD

(71) Applicant: Caterpillar Inc., Peoria, IL (US)

(72) Inventors: Peter William Anderton, Peoria, IL (US); Nainesh M. Parmar, Bloomington, IL (US); David E. Nelson, Metamora, IL (US); Monte C. Cook, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 14/955,485

(22) Filed: Dec. 1, 2015

(51) Int. Cl.

| | |
|---|---|
| ***B05B 1/04*** | (2006.01) |
| ***B05B 1/26*** | (2006.01) |
| ***B05B 1/28*** | (2006.01) |
| ***B05B 13/00*** | (2006.01) |

(52) U.S. Cl.
CPC ..... *B05B 13/005* (2013.01); *B05B 1/267* (2013.01); *B05B 1/28* (2013.01)

(58) Field of Classification Search
CPC B05B 1/04; B05B 1/044; B05B 1/048; B05B 1/265; B05B 1/267; B05B 1/28; B05B 13/005
See application file for complete search history.

(56) References Cited

U.S. PATENT DOCUMENTS

| | | | | |
|---|---|---|---|---|
| 3,529,772 | A * | 9/1970 | Broderson | B05B 9/06 239/157 |
| 3,552,658 | A * | 1/1971 | Sons | B05B 1/267 239/456 |
| 3,795,366 | A | 3/1974 | McGhie et al. | |
| 3,831,862 | A | 8/1974 | Calder | |
| 4,167,247 | A * | 9/1979 | Sons | B05B 1/267 239/455 |
| 5,823,436 | A * | 10/1998 | Waldrum | B05B 1/04 239/123 |
| 8,444,062 | B2 | 5/2013 | Anderton et al. | |
| 8,864,053 | B2 | 10/2014 | Anderton et al. | |
| 9,044,766 | B2 | 6/2015 | Anderton et al. | |
| 2011/0168808 | A1* | 7/2011 | Mitch | B05B 1/044 239/163 |

* cited by examiner

*Primary Examiner* — Darren W Gorman
(74) *Attorney, Agent, or Firm* — Law Office of Kurt J. Fugman LLC

(57) ABSTRACT

A method for assembling a spray pattern adjustment assembly for use with a spray head assembly is provided. The spray head assembly may define an outlet passage that has a height. The method may include the steps of inserting the spray pattern adjustment assembly having a reduced height compared to the height of the outlet passage into the outlet passage, increasing the height of the spray pattern adjustment assembly to at least match the height of the outlet passage, and substantially fixing the position of the spray pattern adjustment assembly relative to the spray head assembly.

8 Claims, 12 Drawing Sheets

SPRAY PATTERN ADJUSTMENT SYSTEM FOR A SPRAY HEAD

TECHNICAL FIELD

The present disclosure is directed to systems and methods for fluid distribution and, more particularly, to systems and methods for controlled distribution of a fluid in a mobile environment. More specifically, this disclosure relates to spray head components of such systems.

BACKGROUND

Fluid distribution systems, in particular mobile fluid distribution systems, are used in a variety of applications. For example, at mining and construction sites, it is common to use mobile fluid distribution systems to spray water over routes and work areas to minimize the creation of dust during operations. A specific example might include a water truck that sprays water over roads at a mine site. Other applications of mobile fluid distribution systems may include spraying of pesticides and herbicides, e.g., for agricultural use, disbursement of saline solutions on roads for snow and ice control, fire suppression, and the like.

For various reasons, such as cost and consistent fluid application, it is desired to control of the amount and pattern of fluids being distributed, in particular with regard to maintaining a uniform and consistent application of fluid per unit of area. For example, when spraying water on mine roads, it may be desired to uniformly distribute the water over the road surface to avoid applying excess water in specific locations. In particular, it is desired to provide a spray head capable of distributing fluid in a consistently wide spray. The desire is to provide consistent spray patterns in areas, such as on inclines and at intersections, where flow rates may be decreased due to decreased machine speed or the need to decrease the amount of fluid per unit area.

Furthermore, it has been become more desirable recently to limit the places where water is sprayed to provide a dry track or dry line to give tires of vehicles more traction, necessitating further control of the spray pattern provided by spray heads in the field.

SUMMARY OF THE DISCLOSURE

A spray head assembly for a fluid distribution system is provided. The spray head assembly may comprise a base defining a fluid inlet passage extending along an inlet axis, a barrel coupled to the base and defining a barrel chamber extending along a barrel axis, a first deflector extending outwardly from the barrel and defining a first deflector inner surface, a second deflector extending outwardly from the base and defining a second deflector inner surface, wherein the first and second deflector inner surfaces are disposed in opposed, spaced relation to define a fluid outlet passage. A removable spray pattern adjustment assembly may also be provided that is positioned in the fluid outlet passage and that is configured to block a portion of the fluid flow coming through the outlet passage, the spray pattern adjustment assembly including first and second components that are selectively movable relative to each other in the outlet passage.

A spray pattern adjustment assembly for use with a spray head assembly is provided. The spray pattern adjustment assembly may comprise a wedge member that includes a wedge surface, a guide member that includes a wedge surface that is at least partially complimentary shaped to the wedge surface of the wedge member, and a spacer member that is attached to one of either the wedge member or the guide member and wherein the space member is configured to engage the one of the other of the wedge member or guide member.

A method for assembling a spray pattern adjustment assembly for use with a spray head assembly is provided. The spray head assembly may define an outlet passage that has a height. The method may include the steps of inserting the spray pattern adjustment assembly having a reduced height compared to the height of the outlet passage into the outlet passage, increasing the height of the spray pattern adjustment assembly to at least match the height of the outlet passage, and substantially fixing the position of the spray pattern adjustment assembly relative to the spray head assembly.

DETAILED DESCRIPTION

Figure 1:
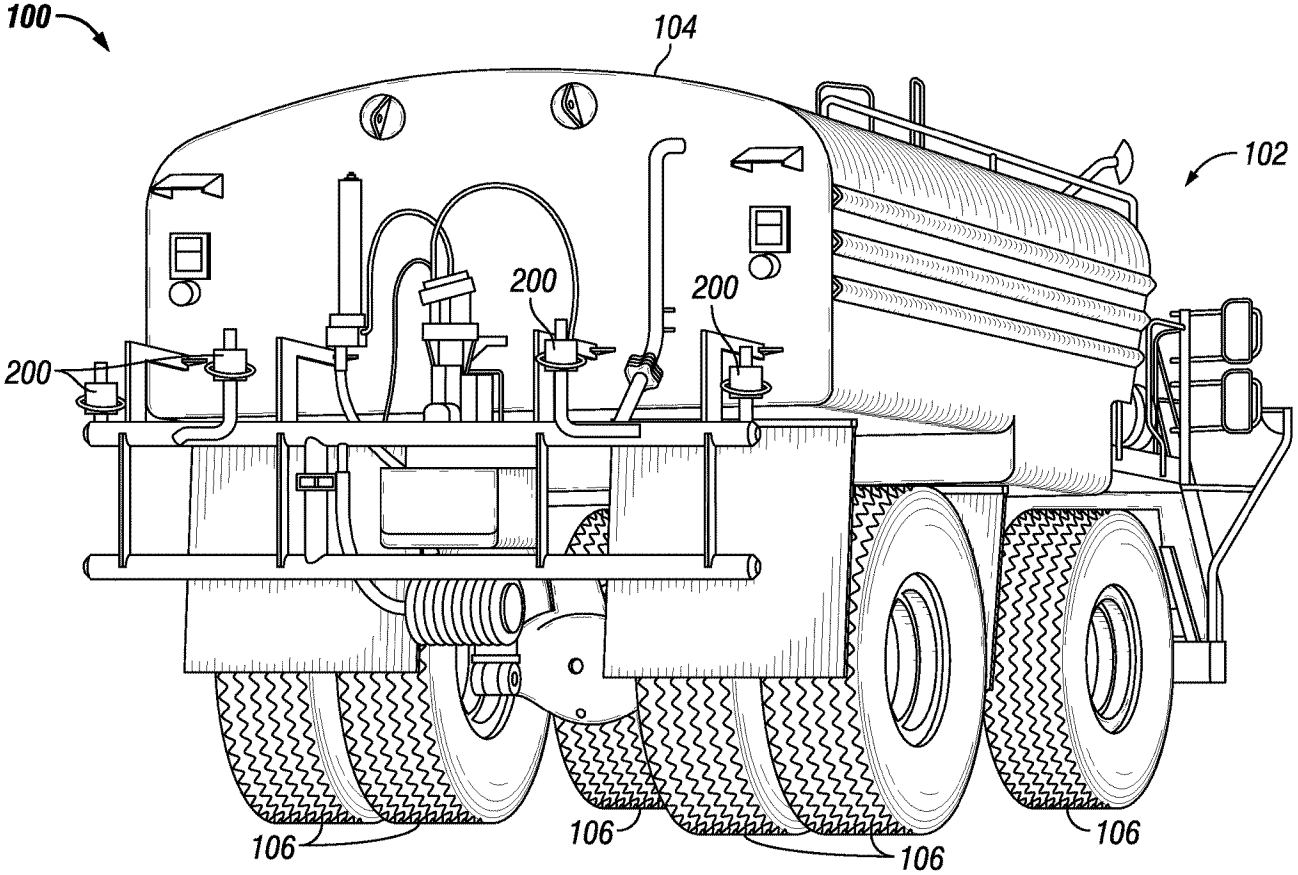
FIG. 1 is a diagrammatic illustration of a mobile machine suited for use with the present disclosure that uses a fluid distribution system.
Figure 2:
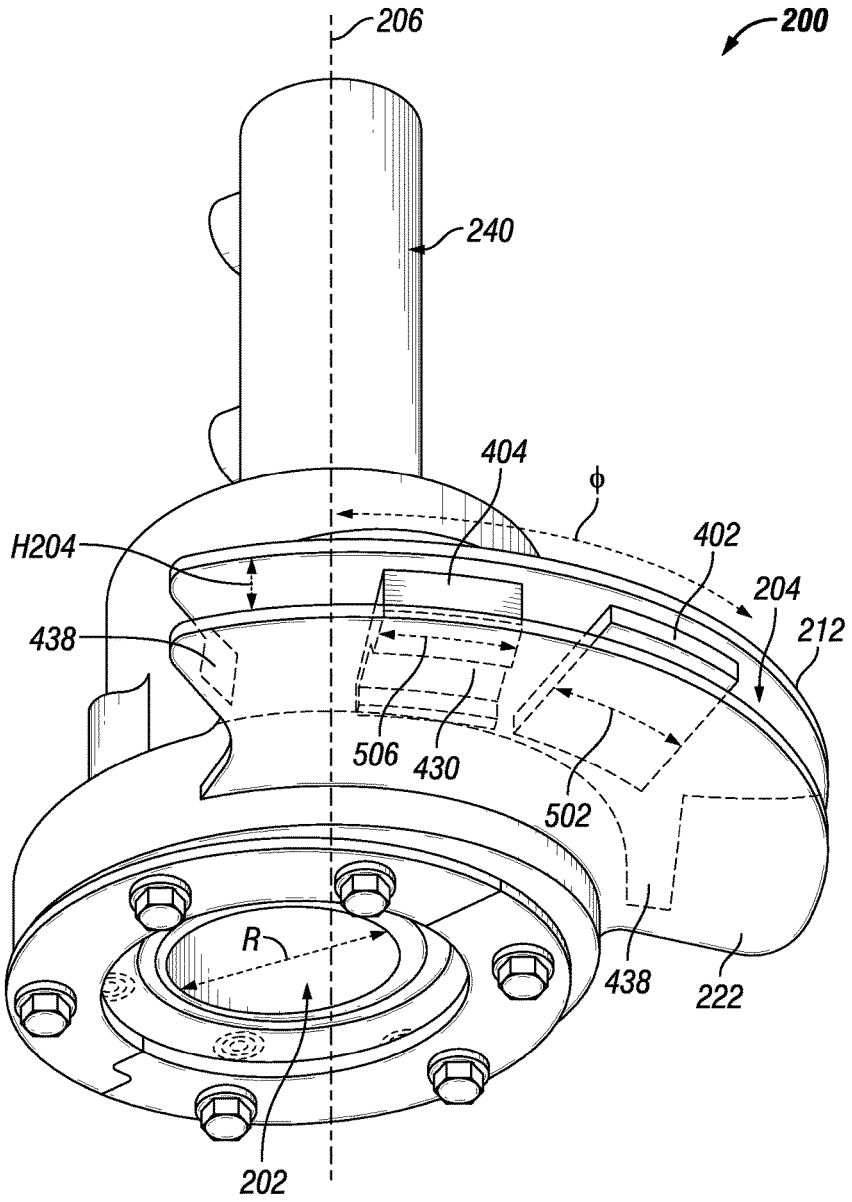
FIG. 2 is a perspective view of a spray head for use in the fluid distribution system of FIG. 1.

This disclosure relates to mobile fluid distribution systems and method for distributing fluids. FIG. 1 illustrates one embodiment of a mobile fluid distribution system 100 according to the present disclosure. The mobile fluid distribution system includes a mobile machine 102 configured to distribute fluids. The mobile machine 102 of FIG. 1 is shown as a truck, i.e., typical for use in off-highway applications, converted for use to distribute fluids. However, other types of mobile machines may be employed, for example, articulated trucks, on-highway trucks, tractor-scrapers, tractors in combination with trailers, and the like.

The mobile machine 102 may be fitted with a fluid tank 104 and a variety of piping, hoses, pumps and valves for fluid distribution purposes. In particular, the mobile machine 102 in FIG. 1 is shown as an off-highway truck configured as a water truck for spraying water at a work site that typically generates undesirable levels of dust during work operations. The present disclosure, however, may also apply to other types of mobile machines configured to distribute water or other types of fluids in a wide variety of applications. For example, a tractor pulling a trailer may be used to distribute chemicals in agricultural settings, an on-highway truck may be configured to spray a saline solution on roads, runways, or parking lots to melt snow and ice, and other varieties of applications and setups may be used.

Turning to FIGS. 2-5, a spray head 200 is shown according to the present disclosure. The spray head 200 may be assembled in relation to a longitudinal axis 206 for reference purposes, and may include the fluid inlet passage 202 and the fluid outlet passage 204 noted above. The outlet passage 204 may be located at a position offset from the longitudinal axis 206 (FIGS. 4 and 5), and the inlet passage 202 may be located at a position offset from the longitudinal axis 206 and in a direction opposed to the location of the outlet passage 204. The location of the inlet passage 202 relative to the location of the outlet passage 204, i.e., on opposite sides of the longitudinal axis 206, may contribute to providing a laminar flow of fluid from the spray head 200. Such laminar flow may result in a flat spray pattern having droplets of a minimal size large enough to achieve reduced atomization of the fluid. In a water truck example, this may contribute to optimal fluid control from the spray head 200 to a desired surface during mobile spraying.

The spray head 200 may include a barrel 208 extending along a barrel axis 210. In the illustrated embodiment, the barrel axis 210 is substantially coincident with the longitudinal axis 206. A first deflector 212 extends outwardly from the barrel 208 to define a first deflector inner surface 214. In the illustrated embodiment, the first deflector 212 is formed integrally with the barrel 208, however the deflector 212 may be formed separately and subsequently coupled to the barrel 208. The barrel 208 may also define a barrel chamber 216.

Figure 4:
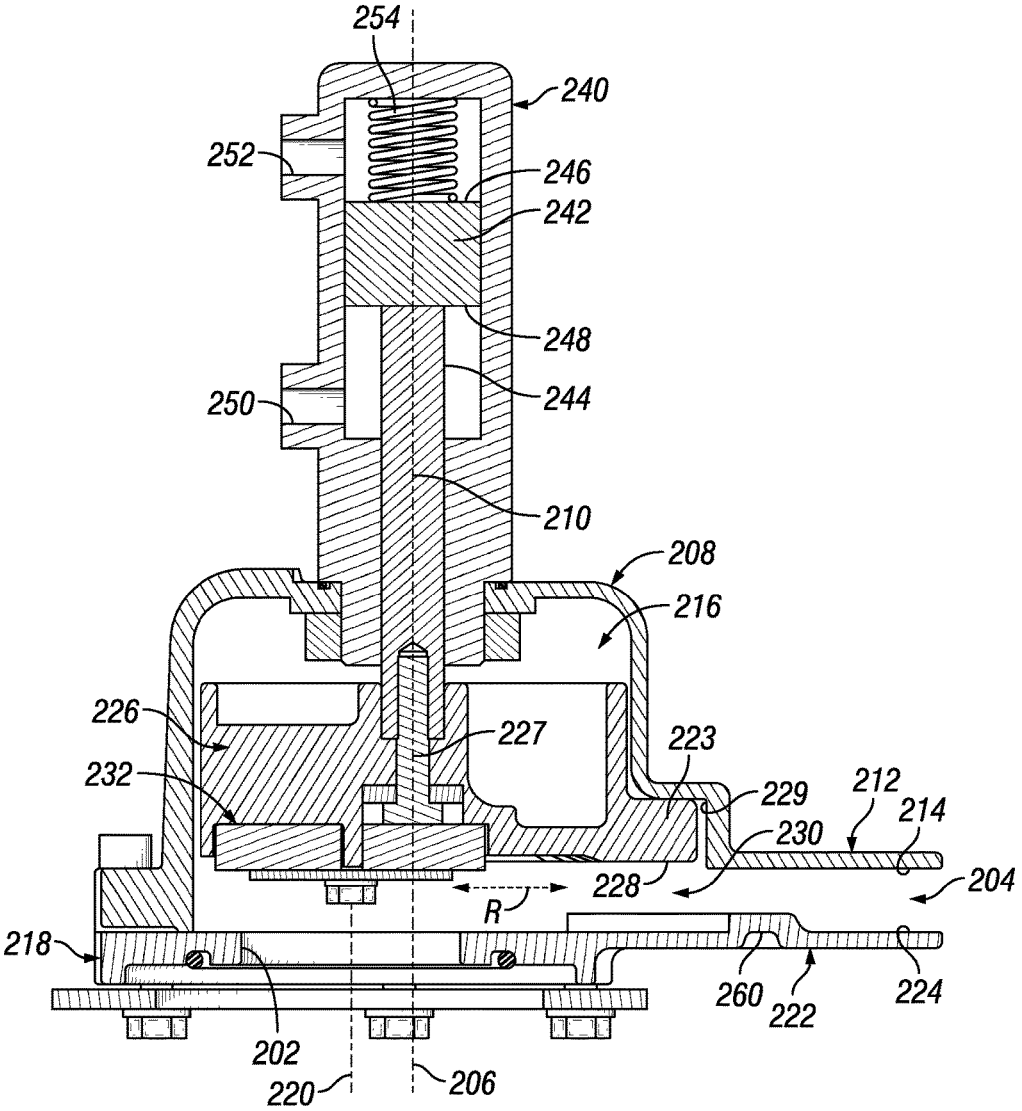
FIG. 4 is a side elevation view, in cross-section, of the spray head of FIG. 2 showing a piston of the spray head in the fully open position.
Figure 5:
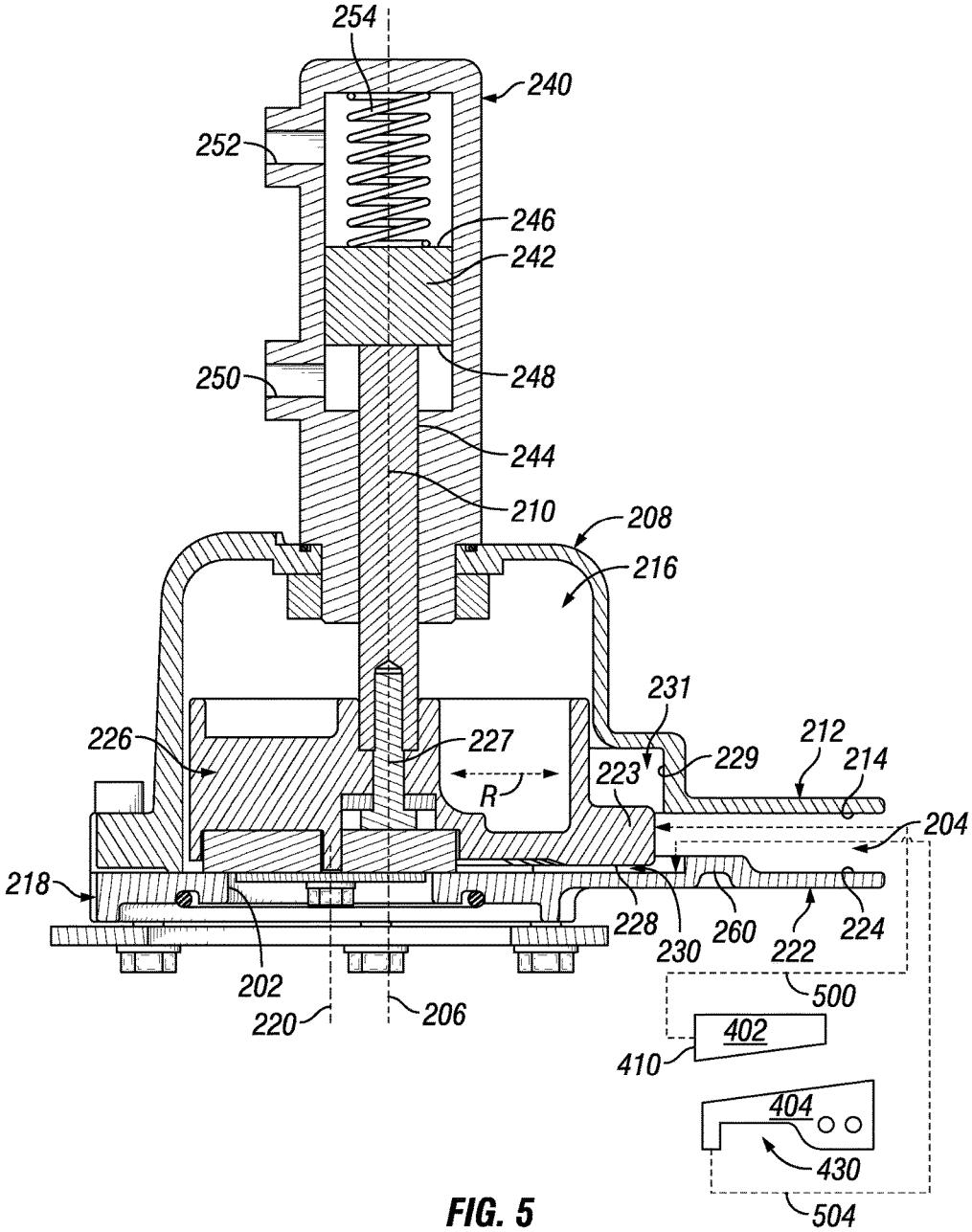
FIG. 5 is a side elevation view, in cross-section, of the spray head of FIG. 2 showing a piston of the spray head in the fully closed position.

A base 218 may be coupled to a bottom of the barrel 208 to substantially enclose the barrel chamber 216. The base 218 may define the fluid inlet passage 202 extending along an inlet axis 220. A second deflector 222 may extend outwardly from the base 218 and define a second deflector inner surface 224. As best shown in FIGS. 4 and 5, the first and second deflector inner surfaces 214, 224 may be disposed in opposed, spaced relation to define the fluid outlet passage 204. The first and second fluid deflectors 214, 224 may be configured to produce a laminar flow through the outlet passage 204 in furtherance of the laminar flow control that may be provided by the above-described specific locations of the inlet and outlet passages 202, 204 relative to the longitudinal axis 206.

Figure 3:
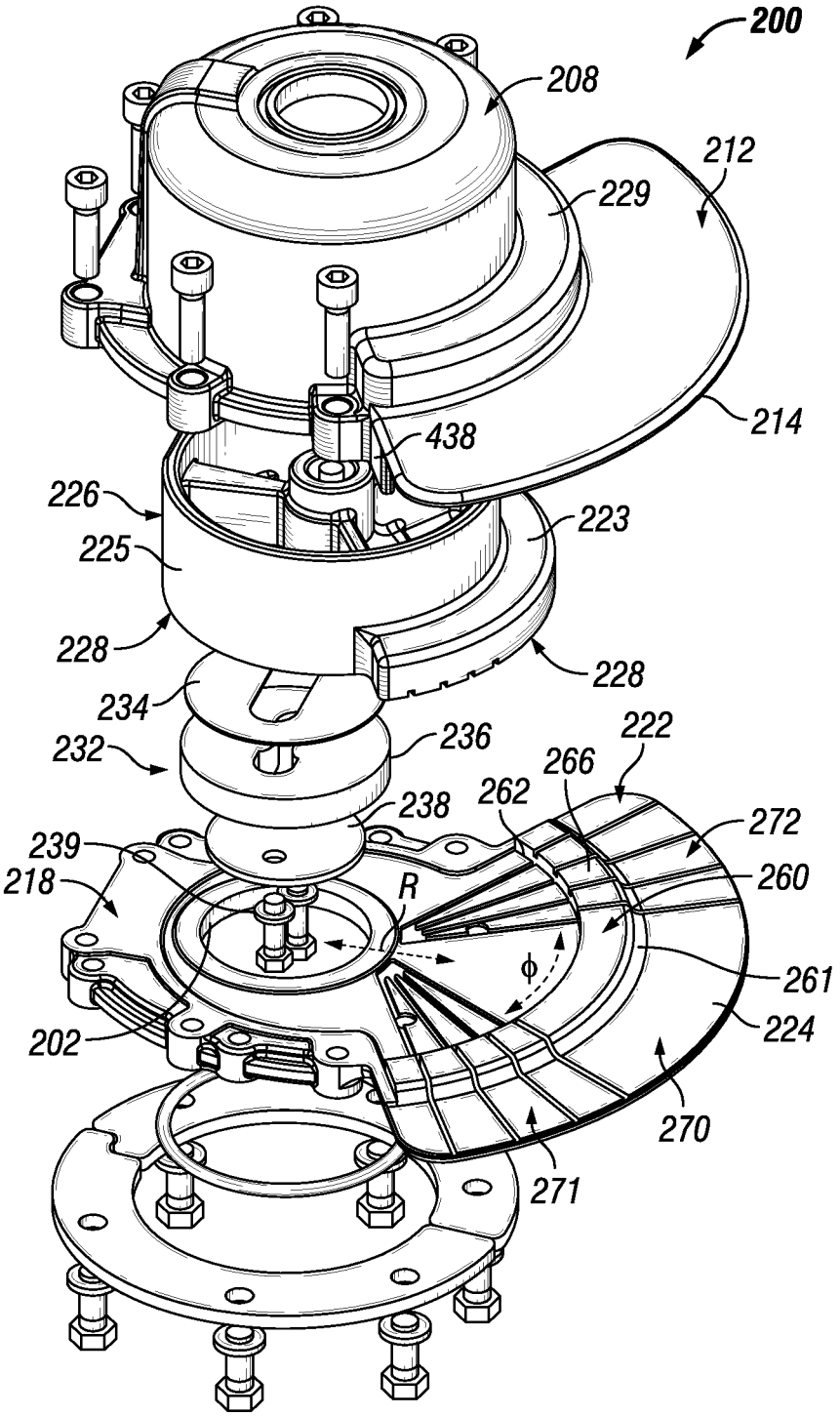
FIG. 3 is an exploded perspective view of the spray head of FIG. 2.

A piston 226 may be slidably disposed in the barrel chamber 216 to selectively control fluid flow from the inlet passage 202 to the outlet passage 204. More specifically, the piston 226 may define a piston axis 227 which, in the illustrated embodiment, is substantially coincident with the longitudinal axis 206 and the barrel axis 210. The piston 226 may include a bottom surface 228 that may be adjustably positioned relative to the base 218, thereby to define an orifice 230 having a variable cross-sectional area. The size of the orifice 230 may be adjusted by positioning the piston 226, thereby to control fluid flow from the inlet passage 202 to the outlet passage 204. As best shown in FIG. 3, the piston 226 may include a generally cylindrical piston body 225 having a dam portion 223 extending radially outwardly from the body 225. The barrel 208 may include a shoulder 229 configured to define a pocket 231 (FIG. 5) of the barrel chamber 216 sized to receive the dam portion 223.

The piston 226 may further include a seal assembly 232 coupled to the bottom surface 228. The seal assembly 232 may include a shim 234, a seal 236, and a washer 238 that are secured to the piston 226 by fasteners, such as bolts 239. The seal 236 may be formed of a material that sealingly engages a portion of the base surrounding the inlet passage 202, so that fluid flow may be stopped when the piston 226 is in the fully lowered position. The use of fasteners to secure the seal assembly 232 to the piston 226 facilitate removal and replacement of components due to wear.

Movement of the fluid piston 226 may be controlled via any suitable means known in the art, such as, e.g., with a single or double acting hydraulic cylinder or an electric motor ballscrew. Specifically, as shown in FIGS. 4 and 5, a hydraulic cylinder 240 is operatively coupled to the piston 226 to control the orifice 230. The hydraulic cylinder 240 includes a hydraulic piston 242 connected to a rod 244, which in turn is connected to the fluid piston 226. In operation, as the hydraulic piston 242 is controlled to move in a linear direction along the longitudinal axis 206, the rod 244 moves and the fluid piston 226 subsequently moves, which results in a change in size of the orifice 230.

In the embodiment shown in FIGS. 4 and 5, the hydraulic cylinder 240 is a double acting hydraulic cylinder 240. That is, the hydraulic cylinder 240 may be hydraulically controlled to move in either direction along the longitudinal axis 206. In more detail, the hydraulic piston 242 includes a head end 246 and a rod end 248. The hydraulic cylinder 240 includes a first hydraulic port 250 positioned to allow hydraulic fluid in the hydraulic cylinder 240 at the rod end 248, and a second hydraulic port 252 positioned to allow hydraulic fluid in the hydraulic cylinder 240 at the head end 246.

The hydraulic cylinder 240 may include a spring 254 disposed in the head end 246. The spring 254 may provide additional force to hold the orifice 230 in a closed position, for example when the hydraulic circuits are shut down. The spring 254 may also be used to supplement the force applied to the head end 246 of the hydraulic cylinder 240. For example, the spring 254 may be selected having a desired compression rate (e.g., force per unit of compression). The total forces applied to the head end 246 may be from a combination of hydraulic fluid supplied to the second hydraulic port 252 and the force of the spring 254, and the total forces applied to the rod end 248 may be from a combination of hydraulic fluid supplied to the first hydraulic port 250 and pressure from fluid entering the inlet passage 202. If the fluid pressure entering the inlet passage 202 is kept fairly constant, then control of the degree of opening of the orifice 230 may be attained by varying the hydraulic fluid to the first hydraulic port 250.

It is noted that the spray head 200 may be configured for control of the fluid piston 226 by use of other configurations. For example, the hydraulic cylinder 240 may be configured without the second hydraulic port 252 and the associated hydraulic components, thus relying on hydraulic pressure on the rod end 248 and spring pressure on the head end 246.

It is further noted that the spray head 200 may be configured for control by other than a hydraulic piston 242. For example, the hydraulic cylinder 240, hydraulic piston 242, and all associated hydraulic circuits and components could be replaced by electrical or mechanical actuators. As specific examples, the fluid piston 226 may be controlled by an electrical actuator such as a solenoid (not shown), or may be controlled by a mechanical actuator which may include any of a variety of cams, screws, levers, fulcrums, and the like (also not shown).

The hydraulic cylinder 240 may be fluidly isolated from the barrel chamber 216, thus isolating the fluid that passes through the orifice 230 from the hydraulic fluid in the hydraulic cylinder 240. This design offers the advantage of keeping particles and contaminants away from the components in the hydraulic cylinder 240, for example when water from retaining ponds is used for dust suppression applications.

The second deflector inner surface 224 may include a weir 260 for further facilitating desirable fluid flow characteristics through the spray head 200. In the embodiment illustrated in FIG. 3, the weir 260 may be formed integrally with the base 218. It will be appreciated, however, that the weir 260 may be formed as a separate component that is subsequently coupled to the base 218. The weir 260 may include curved inner and outer weir walls 262, 264 coupled by a weir surface 266. Accordingly, the weir surface 266 forms a raised portion of the second deflector inner surface 224, which has been found to produce a spray pattern with an increased coverage angle.

Figure 6:
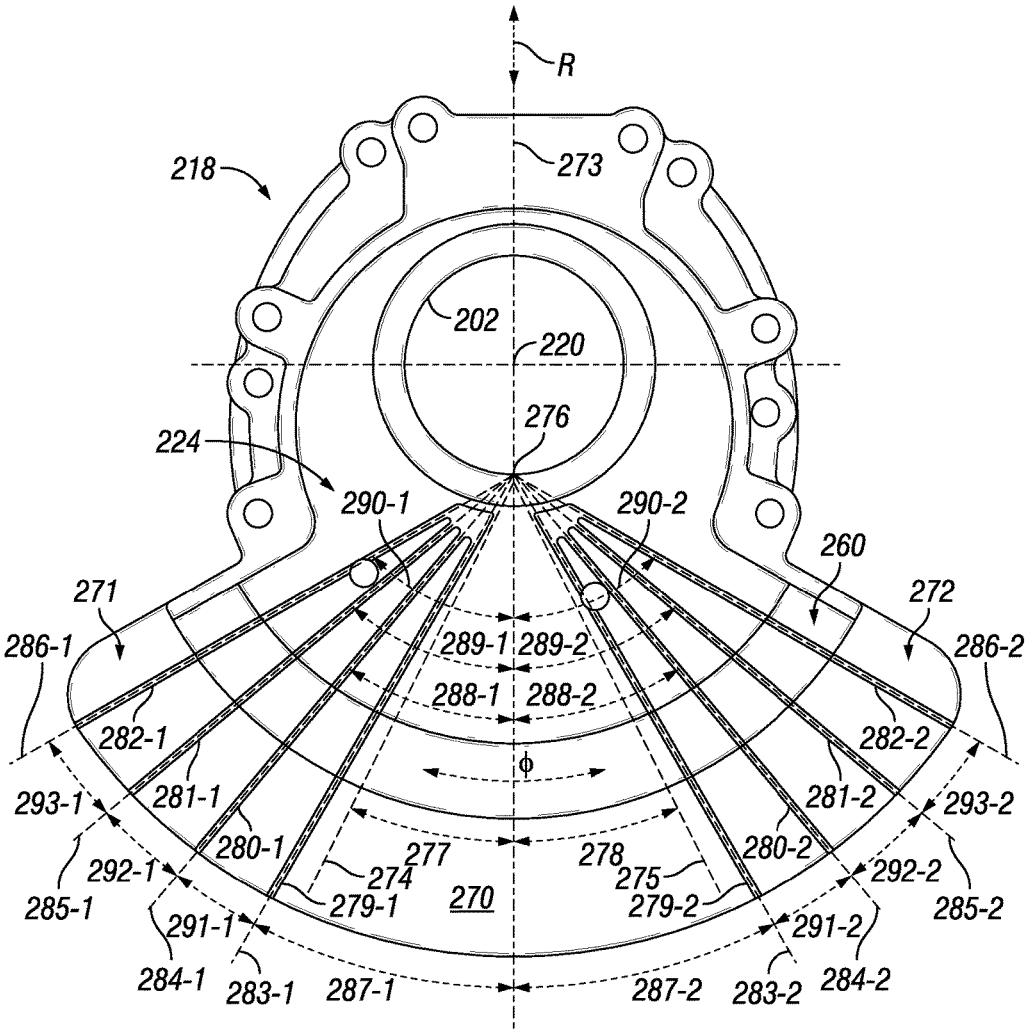
FIG. 6 is an enlarged plan view of a base of the spray head of FIG. 2.

The second deflector inner surface 224 may further include grooveless and grooved regions to promote more uniform fluid flow across the full spray pattern. As best shown in FIGS. 3 and 6, the second deflector inner surface 224 may have a deflector central region 270 that has no grooves and is disposed between first and second deflector lateral regions 271, 272. For reference purposes, a deflector centerline 273 may intersect the inlet axis 220 and extend radially outwardly therefrom to divide the second deflector inner surface into two substantially equal halves. As best shown in FIG. 6, the central region 270 borders both sides of the deflector centerline 273, while the first and second deflector lateral regions 271, 272 are disposed on opposite sides of the deflector central region 270.

In some embodiments, the deflector central region 270 may be bounded by boundary lines provided as references. In the embodiment illustrated in FIG. 6, first and second deflector central region boundary lines 274, 275 extend radially from a deflector vertex point 276 and are disposed on opposite sides of the deflector centerline 273. The deflector vertex point 276 may be disposed on the deflector centerline 273 and may identify the point at which the boundary lines 274, 275 intersect. Relative to the deflector centerline 273, the first deflector central region boundary line 274 may form a first deflector boundary angle 277 and the second central region deflector boundary line 275 may form a second deflector boundary angle 278. In the exemplary embodiment, the first and second deflector boundary angles 277, 278 are substantially equal, and are each at least approximately 20 degrees.

Each of the first and second deflector lateral regions 271, 272 may be formed with at least one groove. As best shown in FIGS. 3 and 6, the first deflector lateral region 271 may be formed with a first deflector groove 279-1, a second deflector groove 280-1, a third deflector groove 281-1, and a fourth deflector groove 282-1. Similarly, the second deflector lateral region 272 may be formed with a first deflector groove 279-2, a second deflector groove 280-2, a third deflector groove 281-2, and a fourth deflector groove 282-2. Each of the deflector grooves may extend along an associated deflector groove path. For example, first deflector groove paths 283-1, 283-2, second deflector groove paths 284-1, 284-2, third deflector groove paths 285-1, 285-2, and fourth deflector groove paths 286-1, 286-2 may be associated with the deflector grooves noted above, as shown in FIG. 7. Each deflector groove path may be oriented substantially radially relative to the inlet passage 202. In the illustrated embodiments, each deflector groove path is oriented to intersect the deflector vertex point 276.

The deflector groove paths may be oriented at different angles within the first and second deflector lateral regions 271, 272. In the embodiment illustrated in FIG. 6, for example, the first deflector groove paths 283-1, 283-2 are disposed relative to the deflector centerline 273 to form respective first deflector groove path angles 287-1, 287-2. Similarly, the second deflector groove paths 284-1, 284-2 form second deflector groove path angles 288-1, 288-2, the third deflector groove paths 285-1, 285-2 form third deflector groove path angles 289-1, 289-2, and the fourth deflector groove paths 286-1, 286-2 form fourth deflector groove path angles 290-1, 290-2, all relative to the deflector centerline 273, wherein the first, second, third, and fourth deflector groove path angles may be different from one another. In some embodiments, the first deflector groove path angles 287-1, 287-2 may be at least approximately 25 degrees to accommodate the grooveless central region 270.

Still further, the angles between adjacent groove paths may be uniformly distributed throughout each of the first and second deflector lateral regions 271, 272 to promote even distribution of fluid flow. The first and second deflector groove paths 283-1, 283-2, 284-1, 284-2 in each of the first and second deflector lateral regions 271, 272 may be adjacent and define therebetween first deflector adjacent angles 291-1, 291-2. Similarly, the second and third deflector groove paths 284-1, 284-2, 285-1, 285-2 may be adjacent and define therebetween second deflector adjacent angles 292-1, 292-2. Finally, the third and fourth deflector groove paths 285-1, 285-2, 286-1, 286-2 may be adjacent and define therebetween third deflector adjacent angles 293-1, 293-2. The first, second, and third deflector adjacent angles 291-1, 291-2, 292-1, 292-2, 293-1, 293-2 may be substantially equal. For example, each of the adjacent angles may be approximately 10 degrees.

The grooves formed in the second deflector inner surface 224 may have a maximum width and depth configured to promote additional fluid flow to the first and second deflector lateral regions 271, 272. For example, each groove may have a groove width of approximately 2 millimeters and a groove depth of approximately 1 millimeter, however other dimensions may be used. The grooves may traverse through the weir 260, if provided. In some embodiments, the grooves may be configured to have a different depth as they traverse the weir 260. That is, the portion of each groove that traverses the weir 260 may have a smaller or larger groove depth than the other portions of the groove. Alternatively, the weir may be grooveless, in which case the weir 260 interrupts each groove. The grooves may be configured to have cross-sectional shapes that are semi-circular, rectangular, square, or other profile shapes.

Figure 7:
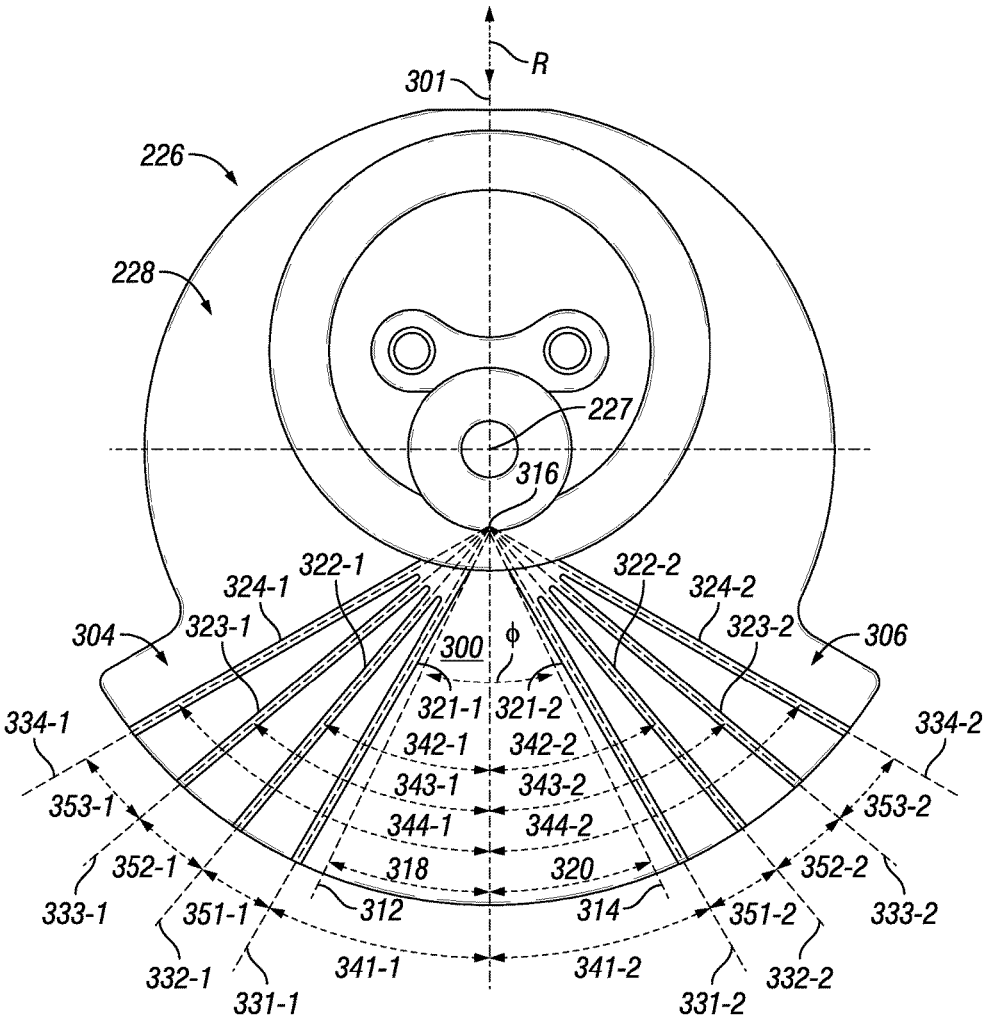
FIG. 7 is an enlarged bottom view of a piston of the spray head of FIG. 2.

To further promote uniform distribution of fluid flow, the piston bottom surface 228 may also include grooveless and grooved regions. As best shown in FIGS. 3 and 7, the piston bottom surface 228 may define a piston central region 300 that has no grooves and is disposed between first and second piston lateral regions 304, 306. For reference purposes, a piston centerline 301 may intersect the piston axis 227 and extend radially outwardly therefrom to divide the piston bottom surface 228 into two substantially equal halves. As best shown in FIG. 7, the piston central region 300 borders both sides of the piston centerline 301, while the first and second piston lateral regions 304, 306 are disposed on opposite sides of the piston central region 300.

In some embodiments, the piston central region 300 may be considered to be bounded by boundary lines provided as a reference. In the embodiment illustrated in FIG. 7, first and second piston central region boundary lines 312, 314 extend radially from a piston vertex point 316 and are disposed on opposite sides of the piston centerline 301. The piston vertex point 316 may be disposed on the piston centerline 301 and may identify the point at which the boundary lines 312, 314 intersect. Relative to the piston centerline 301, the first piston central region boundary line 312 may form a first piston boundary angle 318 and the second central region piston boundary line 314 may form a second piston boundary angle 320. In the exemplary embodiment, the first and second piston boundary angles 318, 320 are substantially equal, and are each at least approximately 20 degrees.

Each of the first and second piston lateral regions 304, 306 may be formed with at least one groove. As best shown in FIGS. 3 and 7, the first piston lateral region 304 may be formed with a first piston groove 321-1, a second piston groove 322-1, a third piston groove 323-1, and a fourth piston groove 324-1. Similarly, the second piston lateral region 306 may be formed with a first piston groove 321-2, a second piston groove 322-2, a third piston groove 323-2, and a fourth piston groove 324-2. Each of the piston grooves may extend along an associated piston groove path. For example, first piston groove paths 331-1, 331-2, second piston groove paths 332-1, 332-2, third piston groove paths 333-1, 333-2, and fourth piston groove paths 334-1, 334-2 may be associated with the piston grooves noted above, as shown in FIG. 7. Each piston groove path may be oriented substantially radially relative to the piston axis 227. In the illustrated embodiments, each piston groove path is oriented to intersect the piston vertex point 316.

The piston groove paths may be oriented at different angles within the first and second piston lateral regions 304, 306. In the embodiment best illustrated in FIG. 7, for example, the first piston groove paths 331-1, 331-2 are disposed relative to the piston centerline 301 to form respective first piston groove path angles 341-1, 341-2. Similarly, the second piston groove paths 332-1, 332-2 form second piston groove path angles 342-1, 342-2, the third piston groove paths 333-1, 333-2 form third piston groove path angles 343-1, 343-2, and the fourth piston groove paths 334-1, 334-2 form fourth piston groove path angles 344-1, 344-2, all relative to the piston centerline 301, wherein the first, second, third, and fourth piston groove path angles may be different from one another. In some embodiments, the first piston groove path angles 341-1, 341-2 may be at least approximately 25 degrees to accommodate the grooveless central region 300.

Still further, the angles between adjacent groove paths may be uniformly distributed throughout each of the first and second piston lateral regions 304, 306 to promote even distribution of fluid flow. The first and second piston groove paths 331-1, 331-2, 332-1, 332-2 in each of the first and second piston lateral regions 304, 306 may be adjacent and define therebetween first piston adjacent angles 351-1, 351-2. Similarly, the second and third piston groove paths 332-1, 332-2, 333-1, 333-2 may be adjacent and define therebetween second piston adjacent angles 352-1, 352-2. Finally, the third and fourth piston groove paths 333-1, 333-2, 334-1, 334-2 may be adjacent and define therebetween third piston adjacent angles 353-1, 353-2. The first, second, and third piston adjacent angles 351-1, 351-2, 352-1, 352-2, 353-1, 353-2 may be substantially equal. For example, each of the adjacent angles may be approximately 10 degrees.

The grooves formed in the piston bottom surface 228 may have a maximum width and depth configured to promote additional fluid flow to the first and second piston lateral regions 304, 306. For example, each groove may have a groove width of approximately 2 millimeters and a groove depth of approximately 1 millimeter, however other dimensions may be used. The grooves may be configured to have cross-sectional shapes that are semi-circular, rectangular, square, or other profile shapes.

In the illustrated embodiments, the grooves formed in the piston 226 are shown as generally mirroring the grooves formed in the second deflector inner surface 224. It will be appreciated, however, that the piston 226 and second deflector inner surface 224 may have different numbers of grooves disposed at different angles. Furthermore, only one of the piston 226 and second deflector inner surface 224 may have grooves while still benefiting from the advantages disclosed herein.

Turning now to FIGS. 8 thru 11, a spray pattern adjustment system or assembly 400 is provided. It may sometimes be desirable to modify the width or angular extent of the spray pattern to provide areas that are drier than others on the ground. For example, under some circumstances an operator may wish to leave a dry strip along a road at a mine site. The spray pattern adjustment assembly 400 may comprise a top wedge member 402, a bottom guide member 404, a spacer member 406 and a keeper member 408 (shown in FIGS. 12 and 13). The assembly 400 is configured to facilitate its insertion into the flow area or outlet passage 204 located between the deflectors 212, 222 of the spray head without disassembly of the spray head 200 in the field (see FIGS. 1 thru 7).

The top wedge member 402 comprises a radially inner arcuate surface 410, a radially outer arcuate surface 412, and two end surfaces 414 which define an angle $\alpha$ between them. In the embodiment shown, the angle $\alpha$ may vary from 20 to 30 degrees. The outer arcuate surface 412 may essentially match the outer curvatures of the deflector plates 212, 222 such that it is fairly flush with those surfaces once assembled in the outlet passage 204. Similarly the inner arcuate surface 410 may be close in proximity to and concentric with the outer curvature of the seal assembly 223 of the piston (best seen in FIG. 5). The top wedge member 402 also includes a level top surface 415 and an angled wedge surface 416 on its bottom side. As shown best in FIG. 11, the angle $\beta$ formed by the top flat surface and wedge surface may be about 3 degrees. Angles $\alpha$ and $\beta$ may be varied as desired.

The bottom guide member 404 also includes a radially inner arcuate surface 420, a radially outer arcuate surface 422, and two end surfaces 424 which define an angle $\alpha$ between them. In certain embodiments, the angle $\alpha$ between the two end surfaces 424 may substantially match angle $\alpha$ of the wedge member. The inner and outer arcuate surfaces 420, 422 may be approximately flush with the corresponding inner and outer arcuate surfaces 410, 412 of the wedge member 402 once the two components are assembled. The bottom surface 426 of the guide member 404 is essentially flat and parallel with the top surface 415 of the wedge member 402 once the components are assembled. The top wedge surface 428 is complimentary shaped for engagement with the wedge surface 416 of the wedge member 402, that is to say it forms the same angle β with the bottom flat surface 426 that is present with respect to the wedge member.

It is contemplated that instead of using completely complimentary wedge surfaces on the guide and wedge members, cam features may be substituted that are designed to engage each other to move one component relative to another without maintaining consistent contact along these features.

The guide member 404 also defines a guide slot 430 on the bottom surface 426 that is complimentary shaped to the weir 260 found on the lower deflector 222, guiding movement of the guide member 404 along the angular extent ϕ of the lower deflector and preventing its movement relative to the spray head 202 in the radial direction R in a manner that will be discussed later herein (see FIGS. 3 thru 5). A pair of holes 432 is provided on each side surface 424 that may be threaded and used with fasteners and the keeper member as will be discussed shortly.

The spacer member 406 is simply constructed and may be welded, otherwise attached to, or formed integral with the wedge member 416. Once the wedge member 402 and spacer member 406 are assembled with the guide member 404 in the outlet of the spray head, the spacer member 406 prevents movement of the wedge member 402 along an angular direction ϕ toward the centerline 273, 301 of the outlet passage 204 between the deflectors 212, 222 (see FIGS. 6 and 7) as the spacer member 406 abuts the side 424 of the guide member 418.

Figure 12:
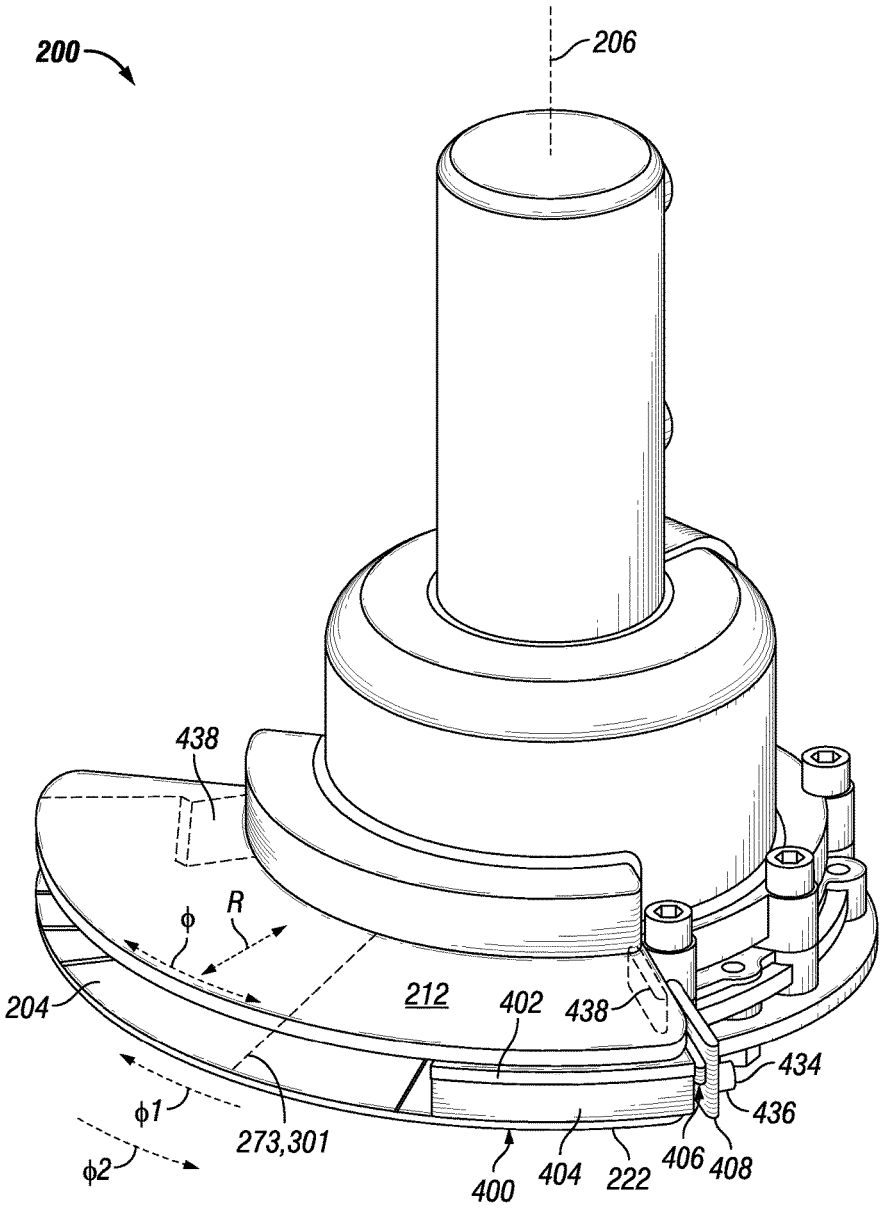
FIG. 12 illustrates a perspective view of a spray head with a spray pattern adjustment assembly inserted into the flow area.
Figure 13:
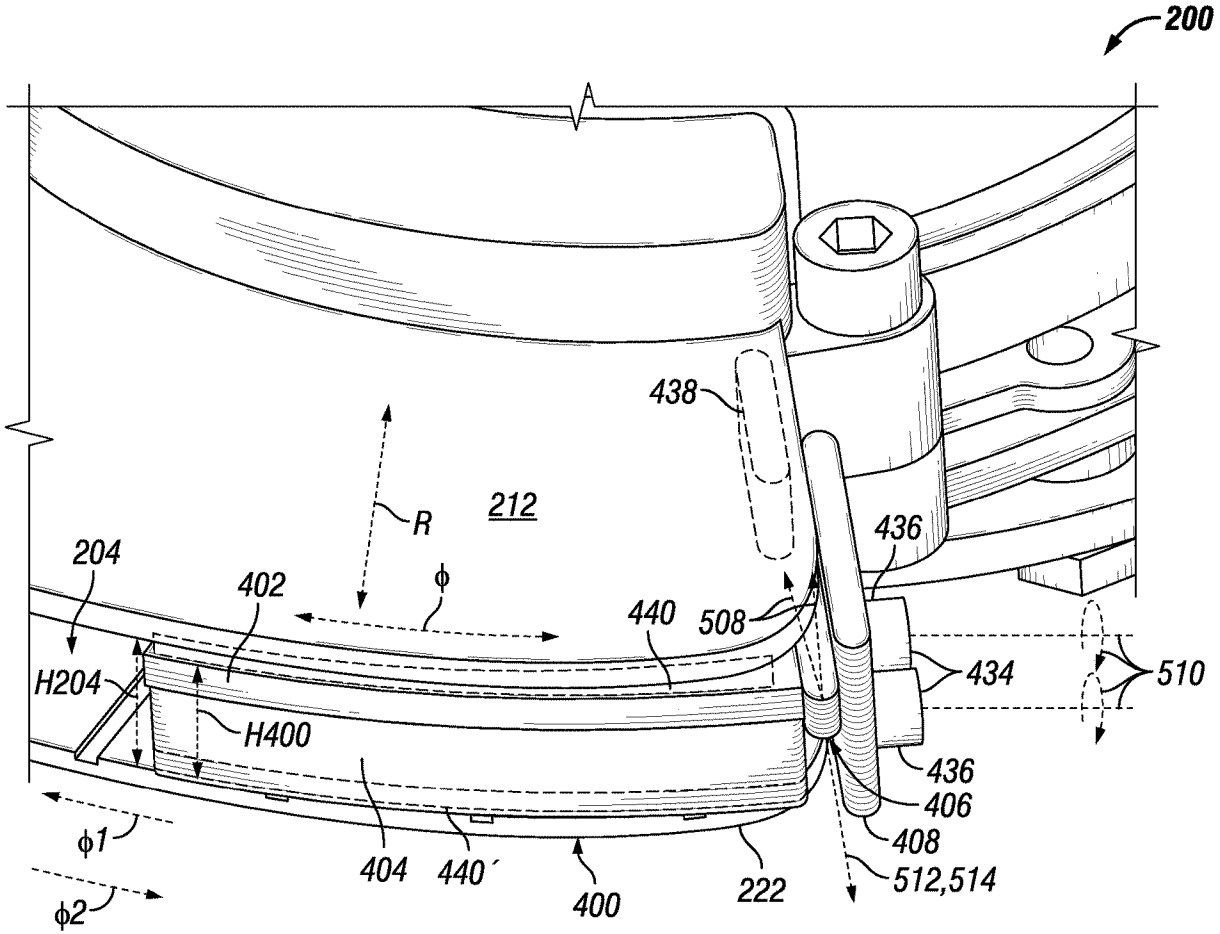
FIG. 13 is an enlarged perspective view of the spray head of FIG. 12.

As shown by FIGS. 12 and 13, the keeper member 408 abuts the upper and lower deflectors 212, 222 and traps the spacer member 406 between itself and the guide member 404, preventing movement of the guide member 404 in the same angular direction ϕ1 that the spacer member 406 prevents movement of the wedge member 402 relative to the guide member 404. Since the fasteners 434 pass through the clearance holes (not shown) of the keeper member 408 and hold onto the guide member 404 via the threaded connection, any movement of the wedge member 402 or guide member 404 are transferred to the threaded connection, then to the fasteners 434, whose heads 436 then press on the keeper member 408, which finally presses upon the upper and lower deflectors 212, 222. This prevents movement of the spray pattern adjustment assembly 400 in the first angular direction ϕ1 toward the centerline 273, 301 of the flow area 204. The keeper member may be otherwise operatively connected to the guide member or wedge member such as by using clips, welding, etc. The keeper member may also contact another portion of the spray head assembly if so desired, although this will typically be on the exterior of the spray head assembly.

Conversely, movement of the assembly 400 in a second angular direction ϕ2 opposite the first angular direction is prevented by the abutment of the guide member 404 or wedge member 402 against a stop or ledge 438 found adjacent the upper flow deflector 212 as best seen in FIGS. 2, 3, 12 and 13. That is to say, the sides of the guide member 404 and wedge member 402 extend further in the radial inner direction R of the outlet passage 204 than a radial extent of the ledge 438, creating a catch point that prevents their removal past the ledge once assembled together. Also, movement of the spray pattern adjustment assembly 400 is prevented in the radial direction R by the interface between the guide slot 430 and the weir 260 of the lower deflector 222 as best seen in FIG. 5. The guide slot or other similar feature may be configured to engage another portion of the spray head assembly. The guide member may be said to engage an inner surface of the lower deflector. The spacer member may be said to be interposed between the guide member and wedge member on one side and the keeper member on the other side. The method of assembly of the spray pattern adjustment assembly into the flow area of the spray head will discussed later herein.

Figure 8:
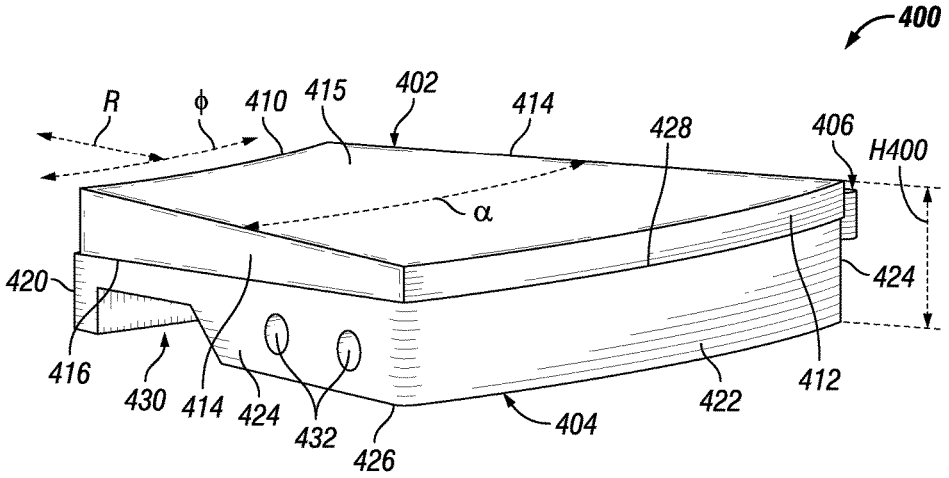
FIG. 8 is a perspective view of a spray pattern adjustment assembly according to a first embodiment of the present disclosure, showing the left side of the assembly.
Figure 9:
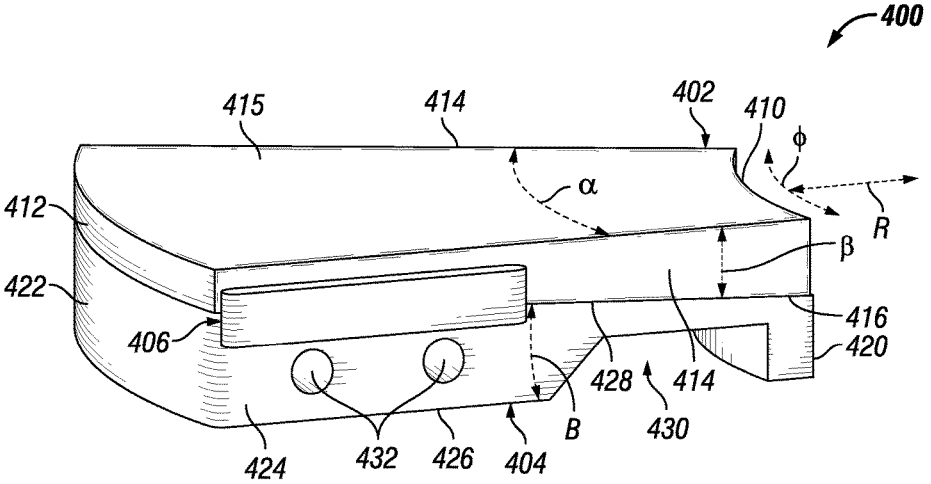
FIG. 9 is an alternate perspective view of the spray pattern adjustment assembly of FIG. 8, showing the right side of the assembly.
Figure 10:
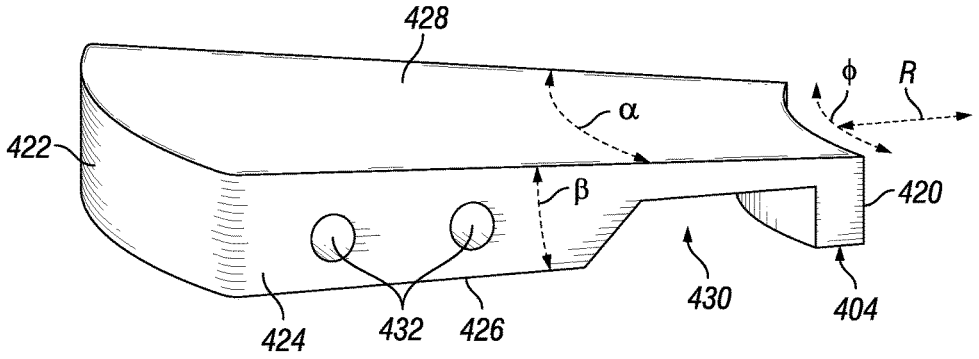
FIG. 10 illustrates the guide member of the spray pattern adjustment assembly of FIG. 9 isolated from the assembly.
Figure 11:
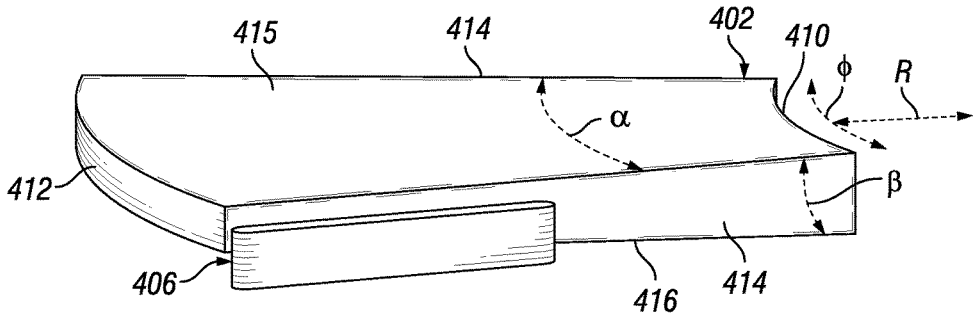
FIG. 11 illustrates the wedge member and spacer member of the spray pattern adjustment assembly of FIG. 9 isolated from the assembly.

As best illustrated by FIGS. 8, 9 and 13, the angled surfaces 416, 428 of the wedge member 402 and guide member 404 cooperate such that the force of the water that presses on the wedge member 402 in the radial direction R causes it to rise up on the guide member 404, causing the overall height H400 of the assembly 400 to increase, pinching it between the upper and lower deflectors that define the height of the outlet passage H204, helping to keep the assembly in place in use. Also, this ability to alter the overall height of the assembly helps when installing the assembly as will be described shortly.

The angular extent a of the assembly and its individual components may be varied as desired. Referring to FIGS. 8 thru 13, this embodiment may range from 20 to 30 degrees, meaning that 20 to 30 degrees of the angular extent ϕ of the spray pattern may be eliminated on a side of the flow centerline 273, 301 if desired. The assembly and components themselves may be mirrored about a plane of symmetry such as a plane that passes through the flow centerlines 273, 301 and axis 206. Also, the instances of the assemblies may be mirrored about this plane, meaning that 40 to 60 degrees of the spray pattern may be reduced. Furthermore, the features on the top and bottom members may be exchanged with each other and the spacer member may be attached to the bottom member instead of the top member, etc. In other words, the spacer member may be attached to one of either the wedge member or the guide member and the spacer member may be configured to engage the one of the other of the wedge member or guide member.

In other embodiments, the angular extent or dimension of the assembly may only be 10 to 20 degrees. In such a case, left and right sided assemblies that are different from each other may be provided to provide 20 to 40 degrees of spray pattern reduction if so desired. For example, the threaded holes on the guide members of this embodiment may be on only one side. Other constructions and ranges and values for the angles are possible.

In yet still further embodiments as depicted by FIG. 13, an elastomeric member 440 may be provided on the top surface of the wedge member 402 to provide a better fluid seal. Also, the grooves 442 on the lower deflector 222 may still allow some water to pass through to the outside of the spray head 200 in the blocked off region, albeit a very small amount. This may be reduced by providing an elastomeric member 440' on the bottom of the guide member 404 to better seal off these grooves if desired. The components of the spray pattern adjustment assembly may be made from steel and the elastomeric component may be made from a suitable material known for its sealing characteristics. Other suitable materials may be used for any of these components.

INDUSTRIAL APPLICABILITY

Any of the spray pattern adjustment assemblies discussed herein may be used as follows with any spray head described herein, that is otherwise known in the art, or that will be devised in the art. First, the amount of the desired angular reduction in the spray pattern is determined and then the appropriate assemblies 400 are chosen to be installed into the outlet passage 204 of the spray head 200.

Referring back to FIGS. 2, 5 and 13, first the wedge member 402 is taken by itself and held by the spacer member (not shown in these figures) and installed into the outlet passage 204 by pushing back in the radial direction R until its inner arcuate surface 410 touches or is very close to the arcuate surface of the seal assembly 223 of the piston (see step 500 in FIG. 5). Then, the wedge member 402 is moved in a generally angular direction until it hits a ledge 438 on the left or right side of the upper flow deflector 212 as desired. This process is eased by the amount of clearance present between the height H204 between the upper and lower deflectors 212, 222 and the height of the wedge member (see step 502 in FIG. 2). Next, the guide member 404 is installed into the outlet passage 204 until its guide slot 430 is aligned over the weir 260 of the bottom deflector 222 at which time the guide member is lowered and sits on the weir (see step 504 in FIG. 5). The guide member 404 is then rotated until it slides under the wedge member 402 and hits the ledge 438 along which the wedge member is located (see step 506 in FIG. 2).

While this operation is being performed, the wedge member 402 is held up and pushed radially inward using the spacer member 406 so that the stack up of the wedge member and the guide member is less than the height H204 of the flow area, providing room for movement of the guide member underneath the wedge member (see step 508 in FIG. 13). This may also be referred to as jacking or biasing the wedge member into the proper position (upper right corner of the outlet passage in this case) for mating it with the guide member in the outlet passage. Then the keeper member 408 is fastened onto the guide member 404 as has been already described (see step 510 in FIG. 13).

The vertical slop of the assembly may be removed by manually manipulating the wedge member 402 by pulling back on the spacer member 406 until friction holds the wedge member 402 in place as it rubs on the upper deflector 212 and the guide member 404 (see step 512 in FIG. 13). Additionally or in lieu of this step, flow pressure created by the spray in use may force the wedge member in the radially outward direction, locking it into place (see step 514). Disassembly may be achieved by reversing this process. As can be seen, the wedge and the guide member may represent two components of the spray pattern adjustment assembly that are selectively movable relative to each other in the outlet passage. This may ease assembly and disassembly of the spray pattern adjustment assembly from the spray head assembly. In most embodiments discussed herein, the spray pattern adjustment assembly may be inserted and removed from the outlet passage of the spray head assembly without necessitating the disassembly of the spray head assembly. It is contemplated that in other embodiments the adjustment assembly may be permanently attached and moved relative to the spray head assembly to create various amounts of spray pattern angular extents or dimensions.

Figure 14:
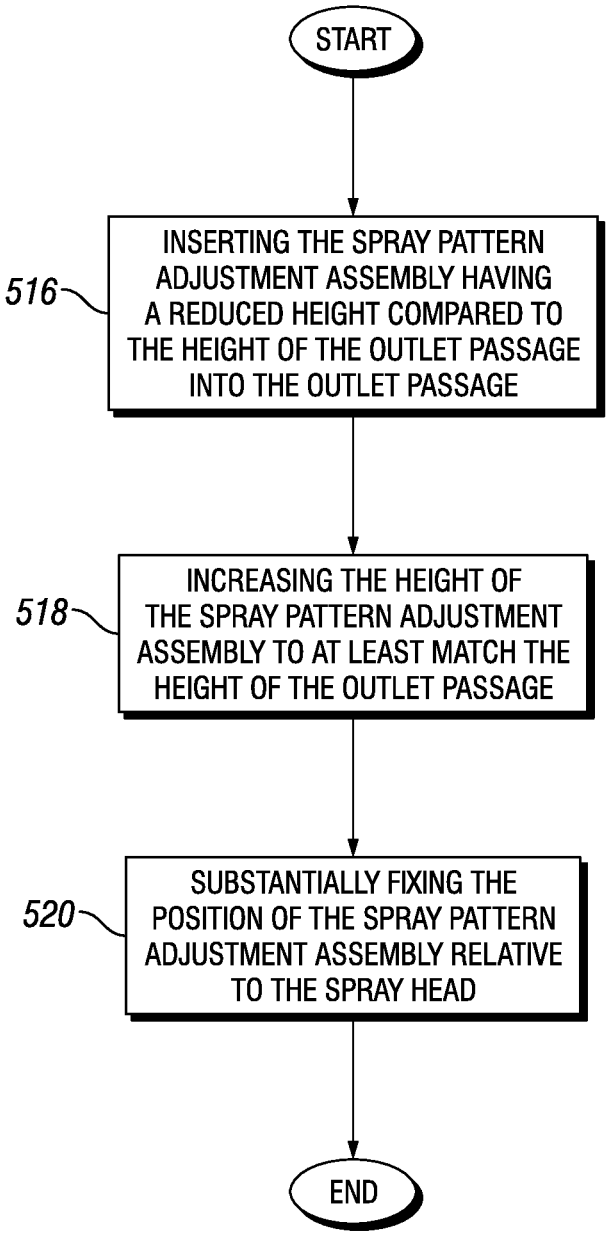
FIG. 14 depicts a flowchart that recites steps for a method of assembling a spray pattern adjustment assembly into the outlet passage of a spray head according to an embodiment of the present disclosure.

As depicted by the flowchart of FIG. 14, the method of assembly may be put into the following general terms. Steps 500, 502, 504, 506 and 508 may be generally characterized as step 516, inserting the spray pattern adjustment assembly 400 having a reduced height compared to the height of the outlet passage 204 into the outlet passage. Similarly, steps 512 and 514 may be generally characterized as step 518, increasing the height of the spray pattern adjustment assembly 400 to at least match the height of the outlet passage. In some cases, a slight preload may be achieved to firmly hold the adjustment assembly into place. Finally, step 510 may be generally characterized as step 520, substantially fixing the position of the spray pattern adjustment assembly 400 relative to the spray head 200. Note that any of the generalized assembly steps may be achieved in other ways than those specifically mentioned herein.

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. Certain steps may be omitted or may be performed in sub-steps.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A spray head assembly for a fluid distribution system comprising:

a base defining a fluid inlet passage extending along an inlet axis;

a barrel coupled to the base and defining a barrel chamber extending along a barrel axis;

a first deflector extending outwardly from the barrel and defining a first deflector inner surface;

a second deflector extending outwardly from the base and defining a second deflector inner surface, wherein the first and second deflector inner surfaces are disposed in opposed, spaced relation to define a fluid outlet passage; and a removable spray pattern adjustment assembly that is positioned in the fluid outlet passage and that is configured to block a portion of the fluid flow coming through the outlet passage, the spray pattern adjustment assembly including first and second components that are selectively movable relative to each other in the outlet passage.

2. The spray head assembly of claim 1, further including:

a piston slidably disposed in the barrel chamber and having a bottom surface; and an orifice defined between the piston bottom surface the second deflector inner surface having a cross-sectional area that varies with piston position to control fluid flow from the fluid inlet passage to the fluid outlet passage; and the second deflector inner surface defining a grooveless deflector central region disposed between first and second deflector lateral regions, each of the first and second deflector lateral regions including at least a first deflector groove extending along a first deflector groove path oriented substantially radially relative to the inlet passage from the fluid inlet passage to the fluid outlet passage.

3. The spray head assembly of claim 1 wherein the spray pattern adjustment assembly is configured to be inserted and removed from the spray head assembly without necessitating the disassembly of the spray head assembly.

4. The spray head assembly of claim 1, wherein at least one of the components of the spray pattern adjustment assembly engages the inner surface of one of the deflectors.

5. The spray head assembly of claim 1, wherein the spray head assembly defines an exterior and at least one of the components of the spray pattern adjustment assembly is operatively connected to the exterior of the spray head assembly.

6. The spray head assembly of claim 1, wherein the first and second components of the spray pattern adjustment assembly include cam features that are configured to engage each other.

7. The spray head assembly of claim 1, wherein the outlet passage defines a corner and the spray pattern adjustment assembly is positioned adjacent the corner of the outlet passage.

8. The spray head of claim 2, further including a weir disposed on the second deflector inner surface, the weir having an inner weir surface spaced from and opposing the orifice, in which each of the first deflector grooves traverses the weir.

* * * * *